United States Patent [19]

Masuda

[11] 4,143,435

[45] Mar. 13, 1979

[54] MATTRESS HAVING A CORRUGATED PLATE

[76] Inventor: Isamu Masuda, Daimyo 1-chome 9-20, Chuo-ku, Fukuoka-shi, Fukuoka, Japan

[21] Appl. No.: 821,434

[22] Filed: Aug. 3, 1977

[51] Int. Cl.[2] ..... A47C 27/08

[52] U.S. Cl. ..... 5/345 R; 5/355; 5/91; 128/1.3; 5/361 B

[58] Field of Search ..... 5/345 R, 355, 361 B, 5/345, 352, 91; 248/206 A; 128/1.3, 1.5

[56] References Cited

U.S. PATENT DOCUMENTS

| | | | |
|---|---|---|---|
| 237,939 | 2/1881 | Wilson | 128/1.3 |
| 272,904 | 2/1883 | Russell | 128/1.3 |
| 410,652 | 9/1889 | Scott | 128/1.3 |
| 2,469,084 | 5/1949 | Schenker | 5/91 |
| 2,532,425 | 12/1950 | Schenker | 5/91 |
| 3,135,974 | 6/1964 | Roman | 5/345 R |
| 3,319,274 | 5/1967 | Upton | 5/345 R |
| 3,323,152 | 6/1967 | Lerman | 5/345 R |
| 3,360,806 | 1/1968 | Dunaway | 5/352 |
| 3,846,857 | 11/1974 | Weinstock | 5/345 R |
| 3,974,532 | 8/1976 | Ecchuya | 5/345 R |
| 4,047,254 | 9/1977 | Hamasu | 5/361 B |
| 4,064,578 | 12/1977 | Yamada | 5/355 |

*Primary Examiner*—Victor N. Sakran
*Attorney, Agent, or Firm*—Frank J. Jordan

[57] ABSTRACT

A mattress of foam rubber having a corrugated board disposed therein. Since the corrugated plate is substantially hard enough to straighten a sleeper's spinal cord, the sleeper can have a sound sleep while enjoying the soft feeling of foam rubber. Furthermore, the foam rubber is also provided with a number of round protrusions on its upper and lower surfaces as well as a number of magnets which are disposed in the valleys formed by those protrusions. Thus the sleeper can have a more sound sleep due to the effect of magnets.

6 Claims, 7 Drawing Figures

MATTRESS HAVING A CORRUGATED PLATE

BACKGROUND OF THE INVENTION

This invention relates to a mattress which provides a sound sleep to a sleeper.

Conventionally, it has been believed that bedding or mattress having a soft feeling assures a sound sleep. Furthermore, with the advent of foam rubber and spring mattresses, the type of bedding used today feels much softer.

However, these types, in general, are so soft that the spinal cord of a sleeper tends to bend downwardly during sleep. Therefore the weight of the sleeper cannot be uniformly supported by the bedding.

Due to the above manner of sleeping, a person often feels pain in his shoulder, waist or spinal cord.

To be more specific, since conventional bedding is made of extremely soft material, such as urethane foam rubber, the central portion (e.g. shoulder, waist or hip) of the sleeper's body sinks into the bedding.

Therefore, sufficient respiration to impart a sound sleep cannot be obtained while the blood is congested and the body temperature is high in those areas which come into direct contact with the mattress. Both of these prevent the sound sleep which also occurs on the part of the body (e.g. shoulder, hip or waist) that sinks into the bedding.

On the other hand, some people believe that a bedding made of hard material assures a sound sleep. However, in practice, this type of bedding is not suitable for any person except youngsters, since it causes the upward curving of the spine and the stretching of muscles.

Therefore, it is of vital importance that the ideal condition of a mattress be such that it is soft to the touch yet firm enough to uniformly distribute the sleeper's weight.

It is an object of the present invention to provide a mattress which can resolve the afore-mentioned defects of conventional beddings, including the spring mattresses.

It is another object of the present invention to provide a mattress which can enhance the circulation of the blood within the body as well as set the sleeper free from pains that occur in the shoulders or areas which come in direct contact with the upper surface of the bleeding.

It is still another object of the present invention to provide a mattress which is further equipped with a desired number of magnets which can effectively cure the deficiency syndrome of magnetic fields, such as the imbalance of autonomic nerve or the stiffness in the shoulders.

BRIEF DESCRTIPTION OF THE DRAWINGS

DETAILED DESCRIPTION OF THE DISCLOSURE

Figure 1:
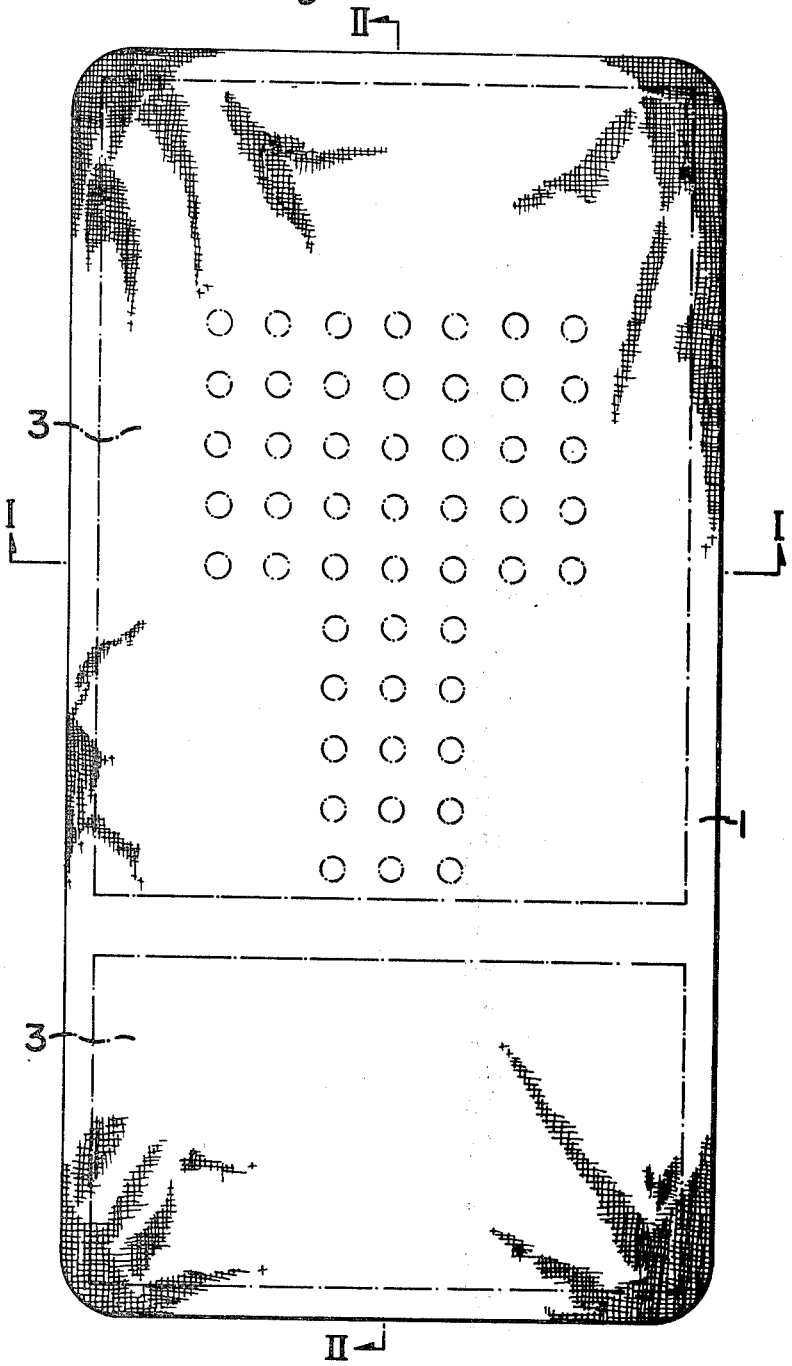
FIG. 1 is a plan view of the mattress of this invention.
Figure 3:
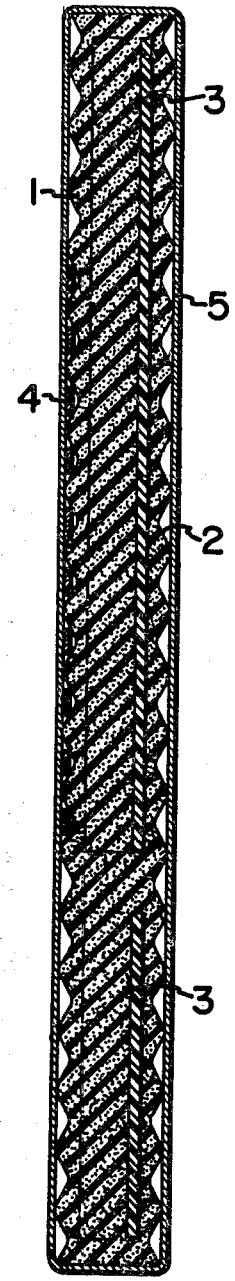
FIG. 3 is a cross-sectional view of the above mattress taken along the line II—II of FIG. 1.
Figure 2:
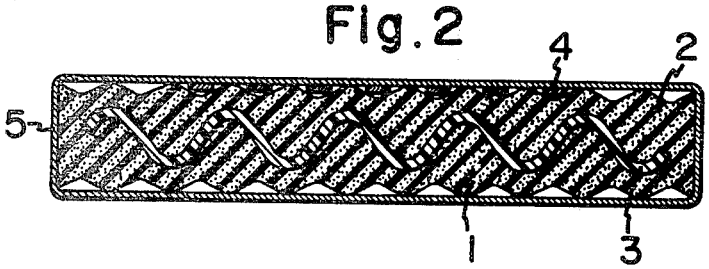
FIG. 2 is a cross-sectional side view of the above mattress taken along the line I—I of FIG. 1.
Figure 4:
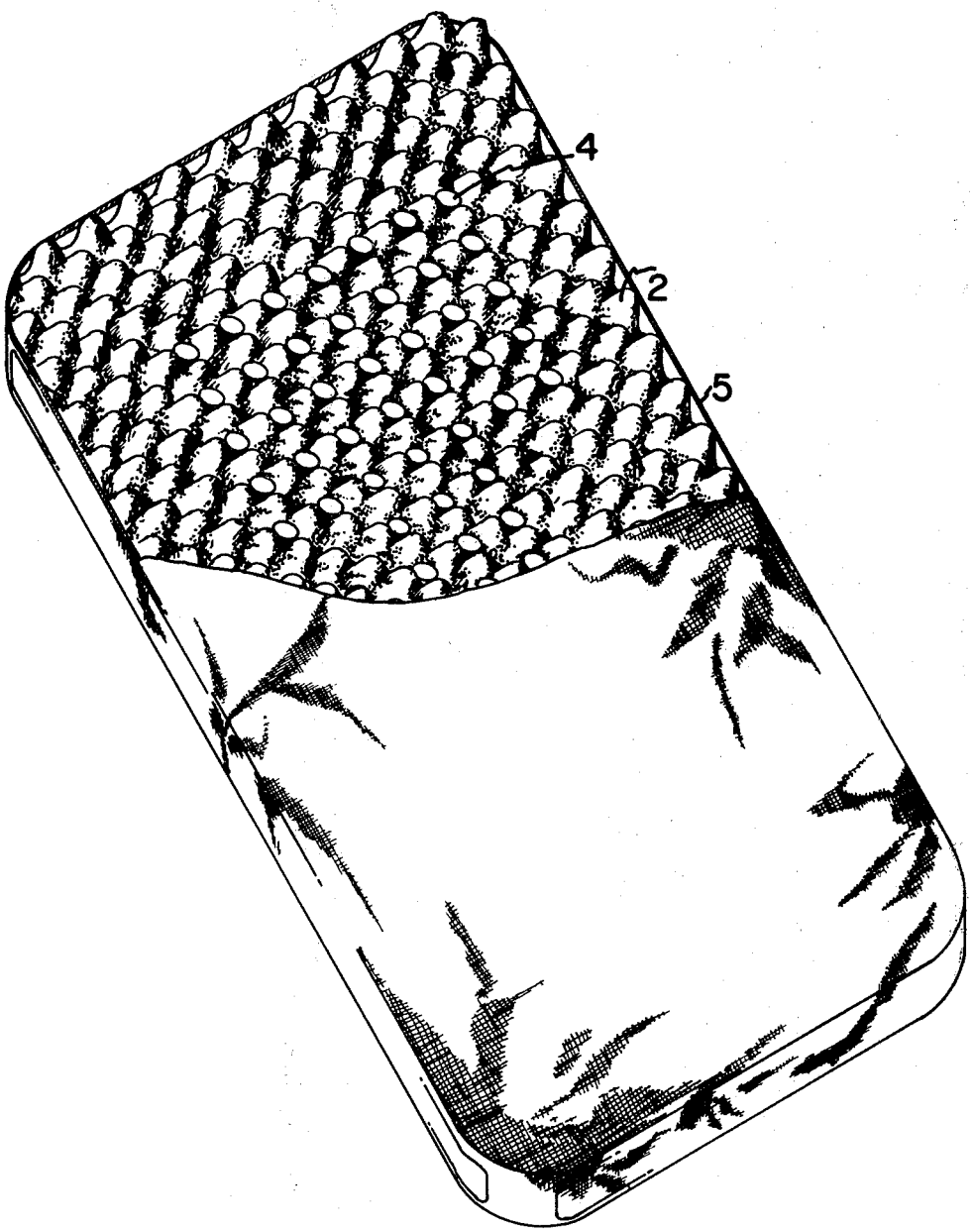
FIG. 4 is a perspective view with a part broken away of the above mattress.

The mattress of this invention is hereinafter disclosed in conjunction with attached drawings, FIG. 1 through FIG. 4.

In the drawings, numeral 1 indicates a mattress of rectangular shape (eg. 1900mm × 1300mm × 40mm) which is made of semi-hard urethane foam rubber such as Rubbetan F or Rubbetan H (both are trademarks produced by Toyo Rubber Industry Co., Ltd of Japan). This mattress is provided with a number of round protrusions 2 on both upper and lower surfaces thereof and these protrusions 2 form a regular pattern.

Referring to the configuration of each protrusion 2, it is preferable that the pitch between the protrusions 2 is about 27 to 35 mm (1.06" to 1.38") while the height of the protrusion 2 is about 10 mm (0.39").

The mattress of this invention is substantially featured by the provision of a corrugated board of hard material, such as plastic, which is sandwiched between the upper layer and the lower layer of the mattress 1.

Due to the above employment of the corrugated board, when a sleeper lies on the mattress, no specific portion of his body (e.g hip or waist) sinks deep into the mattress. Namely, the weight of his body is uniformly distributed over the mattress so that he can have a sound sleep.

Furthermore, the corrugated board of this invention can consist of large and small portions which terminate at the area of the mattress where the sleeper's knee bends so that the mattress can be easily folded and transferred to a desired storing place such as a closet.

In general, it has been believed that the magnetic force is good for recovering from fatigue or for adjusting the functions of human organs. Especially, the magnetic force is said to be effective for "the deficiency syndrome of magnetic fields" such as stiffness in the shoulders, pain in the spinal cord, waist pain, prostration, the habitual headache or the imbalance of the autonomic nerve.

For providing the above magnetic force, which has a favorable medical effect on those conditions, the mattress of this invention is further provided with a desired number of magnets.

As shown in the drawing, in the valleys, formed between and among protrusions 2, a desired number of magnets 3 are disposed. They are substantially distributed at the portions of the mattress which come into direct contact with the sleeper (e.g shoulder, spinal cord, waist or hip).

The magnets having the following particulars have shown a favorable effect.

thickness: about 3mm (0.12")
diameter: about 11.5mm (0.45")
magnetic flux density: 500–600 gauss It is also preferable that the magnets 4 are mounted in such a way that a slight gap remains between the sleeper's body and the magnets when the sleeper lies on the mattress of this invention.

Referring to other parts of the mattress of this invention, a cloth which can favorably disperse sweat or the like encloses the mattress 1 for providing the softer feeling to the mattress 1.

THE EXPERIMENT RELATED TO THE DISTRIBUTION OF THE SLEEPER'S WEIGHT

In illustrating the performance of the mattress of this invention with respect to the distribution of the sleeper's weight, the following conditions were decided and set up before conducting the experiment.

Two beddings were prepared. One consisted of a conventional mattress of 100mm (3.93") with the cotton-filled thin bedding (Japanese futon) disposed over the mattress. The other consisted of the mattress of this invention and the straw-made bed (Japanese tatami mat).

Four subjects slept on the above two beddings respectively.

Figure 5:
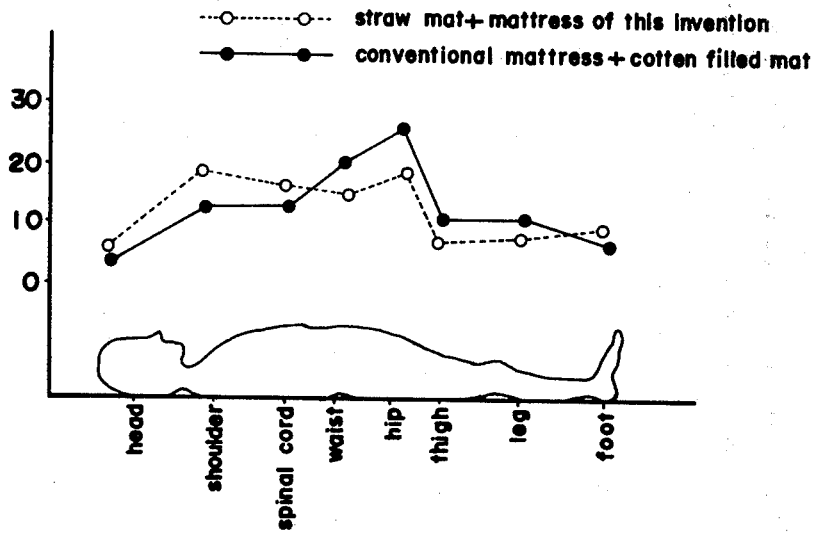
FIG. 5 is the chart showing the differences in body pressure distribution between the conventional mattress and the mattress of this invention.

FIG. 5 shows the mean body pressure change chart obtained by the Manschette method, wherein the weight of the respective portions of the subject is converted into the Manschette's inner pressure, which can be measured as body pressure.

In the chart, the mean weight of the subjects who slept on the conventional mattress is described by a solid line, while the mean weight of the subjects who slept on the mattress of this invention is described by a dotted line.

As can be observed from the chart, the conventional mattress shows high body pressure of about 20 to 25 kg (44.15 to 55.19 lb) at the waist or the hip. This implies that the above portions of the body considerably sink into the mattress.

Whereas, the mattress of this invention shows a body pressure of about 5 to 10kg (11.04 to 22.08 lb) at the head and legs and almost uniform body pressure of about 15kg (33.11 lb) at the shoulder, the spinal cord and the waist.

This implies that no specific parts of the body sink into the mattress as compared to the conventional type and substantially uniform weight distribution can be obtained.

Figure 6A:
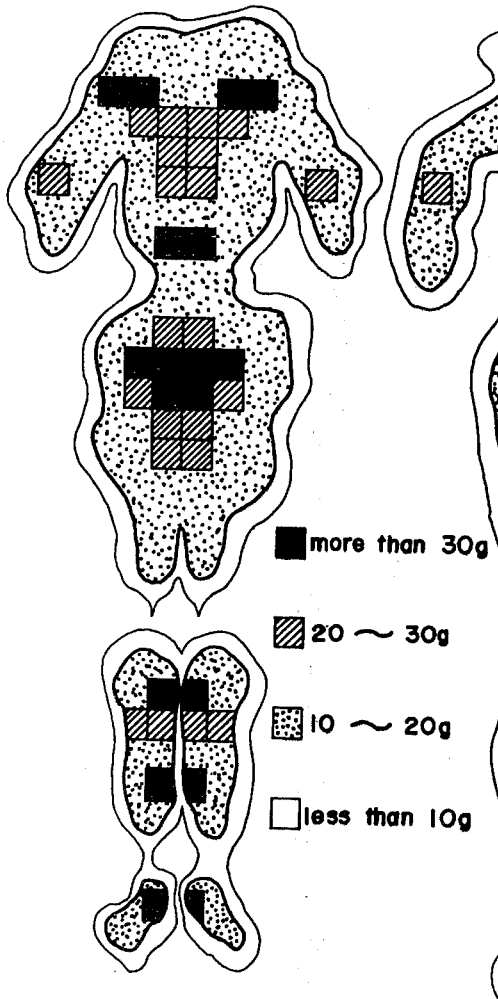
FIG. 6A and FIG. 6B are illustrative views showing the weight distribution of a sleeper who lies on the conventional mattress and the mattress of this invention respectively.
Figure 6B:
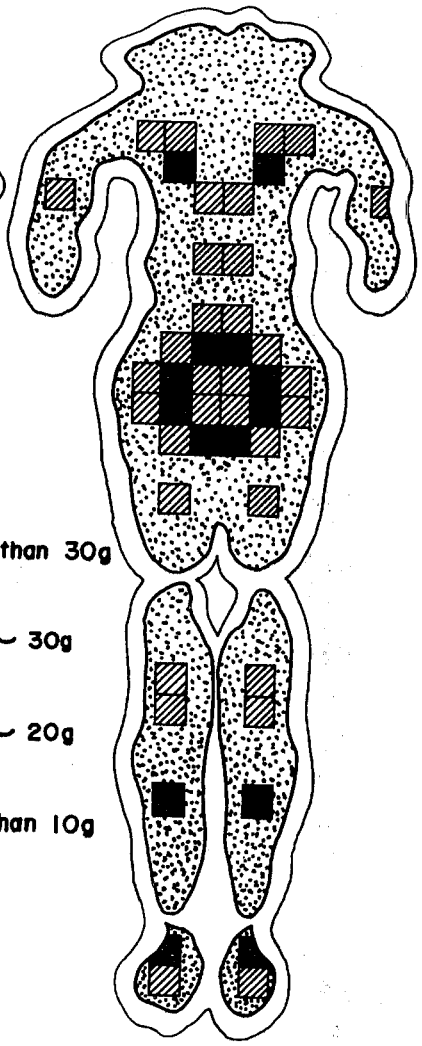

FIG. 6A and FIG. 6B provide other charts showing the length and width distribution of the body pressure measured by Manschette method wherein FIG. 6A relates to pressure distribution of the mattress of this invention while FIG. 6B relates to the pressure distribution of the conventional mattress.

As can be observed from the above charts, the conventional mattress shows that the body pressure substantially concentrates on the area ranging from the waist to the hip, and this area extends in both right and left directions from the spinal cord. The mattress of this invention shows that the body pressure is uniformly distributed over the shoulder, the spinal cord, the waist and the leg portions and no portion of the body is subject to the concentration of body pressure.

These days, the number of people who suffer from waist pain are increasing. It is noted that the main cause of waist pain is the weakening of a muscle or tendon. In the above situation, it is not preferable that the body pressure concentrates on the hip or waist.

Furthermore, the wide contact area, which can be observed when the subject lies on the conventional mattress, also provides a shallow sleep since the humidity or temperature of the contact area rises.

According to the mattress of this invention, since it provides a uniform distribution of weight, the user can have a deep and sound sleep.

What I claim is:

1. A mattress comprising a mattress body of foam rubber having a plurality of protrusions formed on at least the upper surfaces thereof, said protrusions having generally circular cross-sections along imaginary cutting planes disposed parallel to the general plane of the mattress, said protrusions being generally uniformly distributed in both longitudinal and transverse directions, said protrustions having terminating ends disposed in a generally flat common plane, depressions formed between successive protrusions, said depressions being evenly distributed in both longitudinal and transverse directions and alternating with said protrusions in both longitudinal and transverse directions, magnets in at least some of said depressions, said magnets being disposed in said depresssions spaced from said flat common plane such that a gap is provided between the magnets and a user's body supported on the upper surface of the mattress body, said magnets having a flux density of from 500 to 600 gauss, a hard corrugated board means disposed in the mattress between the upper and lower surfaces thereof, said corrugated board means extending over substantially the same area as that of the mattress body, and a covering sheet enclosing the mattress.

2. A mattress according to claim 1, wherein said magnets have a cylindrical configuration with the axes of the cylindrical magnets being disposed perpendicular to the general plane of the mattress.

3. A mattress according to claim 1, wherein each of said protrusions are generally tapered relative to an axis extending perpendicular to the general plane of the mattress body, said tapered protrusions having converging side portions which converge towards said terminating ends of said protrusions, said terminating ends of said protrusions having a spherical-like configuration.

4. A mattress according to claim 1, wherein said protrusions and depressions are formed on the upper and lower surfaces of the mattress body.

5. A mattress according to claim 1, wherein each of the corrugations of the corrugated board means has its longitudinal axis extending transversely of the mattress.

6. A mattress according to claim 1, wherein said corrugated board means comprises two corrugated boards each having juxtaposed edges extending transversely of the mattress, said juxtaposed edges being located closer to one longitudinal and of the mattress than the other longitudinal end such that the juxtaposed edges are disposed generally at the location of a sleeper's knees, whereby the mattress is adapted to be folded along said juxtaposed edges to thereby facilitate storing the mattress.

* * * * *